US011103873B2

(12) United States Patent
Lindberg et al.

(10) Patent No.: US 11,103,873 B2
(45) Date of Patent: Aug. 31, 2021

(54) JAW PLATE RETAINER

(71) Applicant: SANDVIK INTELLECTUAL PROPERTY AB, Sandviken (SE)

(72) Inventors: Marten Lindberg, Malmo (SE); Roger Sjobeck, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 277 days.

(21) Appl. No.: 16/471,989

(22) PCT Filed: Dec. 21, 2016

(86) PCT No.: PCT/EP2016/082226
§ 371 (c)(1),
(2) Date: Jun. 20, 2019

(87) PCT Pub. No.: WO2018/113957
PCT Pub. Date: Jun. 28, 2018

(65) Prior Publication Data

US 2020/0023370 A1 Jan. 23, 2020

(51) Int. Cl.
*B02C 1/10* (2006.01)
*B02C 1/04* (2006.01)

(52) U.S. Cl.
CPC ..... *B02C 1/10* (2013.01); *B02C 1/04* (2013.01); *B02C 2210/02* (2013.01)

(58) Field of Classification Search
CPC .. B02C 1/02; B02C 1/04; B02C 1/043; B02C 1/10
See application file for complete search history.

(56) References Cited

U.S. PATENT DOCUMENTS

| | | | | |
|---|---|---|---|---|
| 1,507,661 | A | 9/1924 | Buchanan | |
| 3,984,058 | A | 10/1976 | Archer et al. | |
| 8,256,698 | B2 * | 9/2012 | Holmes | B02C 1/10 241/207 |
| 10,525,475 | B2 * | 1/2020 | Jokiranta | F16F 1/121 |
| 2015/0174580 | A1 * | 6/2015 | Lindberg | B02C 1/10 241/300 |
| 2015/0292530 | A1 * | 10/2015 | Sjobeck | F15B 15/1461 92/172 |

FOREIGN PATENT DOCUMENTS

| | | | |
|---|---|---|---|
| AU | 687703 | B2 | 2/1998 |
| CN | 204276043 | U | 4/2015 |
| CN | 106163665 | A | 12/2016 |
| EP | 2990119 | A1 | 3/2016 |
| WO | 99/32227 | A1 | 7/1999 |
| WO | 2008046127 | A1 | 4/2008 |
| WO | 2015082765 | A1 | 6/2015 |

* cited by examiner

*Primary Examiner* — Matthew Katcoff
(74) *Attorney, Agent, or Firm* — Corinne R. Gorski

(57) ABSTRACT

A jaw plate retainer assembly is arranged to releasably secure a jaw plate at a jaw of a jaw crusher. The retainer assembly is configured specifically for positioning at a rearward region of the jaw plate, such that no part of the retainer assembly is exposed to the crushing chamber and to protect it when mounted in use by the jaw plate.

15 Claims, 13 Drawing Sheets

JAW PLATE RETAINER

RELATED APPLICATION DATA

This application is a § 371 National Stage Application of PCT International Application No. PCT/EP2016/082226 filed Dec. 21, 2016.

FIELD OF INVENTION

The present invention relates to a jaw plate retainer assembly to releasably secure a jaw plate at a jaw of a jaw crusher.

BACKGROUND ART

Jaw crusher units typically comprise a fixed jaw and a movable jaw that together define a crushing zone. A drive mechanism is operative to rock the movable jaw back and forth in order to crush material within this zone. The crushing zone is generally convergent towards its lower discharge end so that crushable material, fed to an upper and wider end of the zone, is capable of falling downward under gravity whilst being subject to repeated cycles of crushing movement in response to the cyclical motion of the movable jaw. The crushed material is then discharged under gravity through the lower discharge end onto a conveyor belt for onward processing or to a suitable stockpile.

Commonly, the frame that supports the fixed jaw is referred to as the front frame end. The movable jaw is connected to what is typically referred to as a back frame end via a mechanically actuated link mechanism that serves to control and stabilise the oscillating movement of the jaw relative to the stationary jaw. Being common to jaw crushers of this type, crushing plates are removably mounted at both the fixed and movable jaws and represent wear parts that require replacement following periods of use. Conventionally, the wear plates are mounted at respective support frames at the fixed and movable jaws via wedges that abut regions of the crushing plate and are secured at a rearward projecting side of the jaws via anchorage bolts or the like. In particular, an upper clamp bar is typically used and abuts an upper end edge of the jaw plate so as to force the plate against a lower support wedge and compress the plate onto the support frame. Due to the size and weight of the clamping bar, lifting ears are commonly welded to the bar which is than manoeuvred to and from position by an auxiliary crane. The size of the bar is, in part, determined by the fact that conventional bars are positioned in contact with the material flow and become worn. A significant problem with existing bar arrangements is their flattening/squashing that results in bar region overlapping the abutted jaw plate (and or the frame) making removal very difficult. In particular, it is not uncommon for personnel to be required to climb into the jaw chamber in order to try and dislodge the bar from its fused position every time it is required to change a worn jaw plate. Example jaw clamping mechanisms are described in U.S. Pat. Nos. 1,507,661; 3,984,058; AU 1,787,897; WO 99/32227; CN 204276043 and WO 2008/046127. Accordingly, what is required is a jaw plate retainer assembly that addresses the above problems.

SUMMARY OF THE INVENTION

One objective of the present invention is to provide a jaw plate retaining mechanism to releasably clamp a jaw plate at a jaw conveniently and reliably that greatly facilitates demounting of the jaw plate when required. In particular, it is a specific objective to provide a jaw plate mounting arrangement that provides time efficient mounting and dismounting of the jaw plate at the jaw.

It is a further specific objective to provide a mounting assembly that obviates a requirement for personnel to climb into the jaw crushing chamber to manually dislodge the clamping mechanism and/or the jaw plate from its mounted position at the jaw. It is a further general objective to maximise crushing efficiency and capacity in addition to minimising an overall weight of a jaw crusher.

The objectives are achieved by providing a plate retainer assembly that is effectively hidden in its mounting position at a rearward side of the jaw plate. In particular, the present jaw plate retainer does not extend to the forward facing crushing face of the jaw or the uppermost and lowermost lengthwise ends of the jaw plate so as to be positioned exclusively at the rearward facing side of the plate. Accordingly, the present retainer assembly is compatible with a jaw plate that extends completely over the retainer assembly, with the plate providing an effective shield of the retainer assembly from the crushable material. Accordingly, the present assembly is not subject to wear and moreover the significant disadvantages associated with fusing (or overlapping) of the retainer assembly onto or around the jaw plate that would otherwise impede dismounting of the plate from the frame. The subject invention is further advantageous via its mounting position exclusively at the rearward side of the jaw plate such that the length of the jaw plate may be maximised relative to the jaw frame to which the plate is mounted so as to provide a relatively longer (i.e., larger) crushing chamber without an increase in overall crusher height. As will be appreciated, such a configuration is beneficial to reduce the overall weight of a crusher for a desired level of reduction and/or crushing capacity. Additionally, the subject invention avoids the need for the welding of lifting ears onto the retaining assembly and/or jaw plate by providing a relatively smaller retainer capable of imparting at least the same magnitude of clamping force between the jaw plate and the frame part of the jaw.

According to a first aspect of the present invention there is provided a jaw plate retainer assembly to releasably secure a jaw plate at a jaw of a jaw crusher, the assembly comprising a frame forming part of a jaw crusher that, in part, defines one of the jaws of the crusher, the frame having a support face for mounting a jaw plate against which material is to be crushed, at least one retainer being separate to the frame and the jaw plate and extending through the frame and having a head to frictionally engage the jaw plate for mounting against the support face, and an anchor part to secure the head in position at the frame, characterised in that the frame comprises at least one cavity recessed inwardly from the support face, the cavity and the head dimensioned such that the head is capable of being at least partially accommodated within the cavity whilst leaving a free volume region to receive a part of the jaw plate, the head having at least one abutment face to frictionally engage the part of the jaw plate within the cavity and reasonably secure the jaw plate at the jaw.

Preferably, a height of the cavity in a lengthwise direction of the frame and/or the jaw is greater than a width of the head in the same lengthwise direction of the frame and/or the jaw and the free volume region is positioned below the head. Accordingly, the head and cavity are dimensioned to provide the free volume region that may be considered to be an entrapment region into which may be inserted a mount flange of a jaw plate with the mount flange capable of being positionally clamped between the head and a region of the cavity that, in part, defines the free volume region.

Optionally, the cavity is defined, in part, by an upper and a lower cavity face, the head being defined, in part, by an upper and a lower head face, the free volume region defined, in part, between the lower cavity face and the lower head face. Preferably, the head is generally wedge shaped in that the upper and lower head faces are aligned oblique relative to one another. The wedge shaped head comprises a length extending in the widthwise direction of the frame so as to be aligned generally perpendicular to the lengthwise direction of the frame and a jaw plate mounted at the frame. Optionally, the head may comprise a cross sectional shaped profile that is trapezoidal. Preferably, the cavity formed within the frame comprises a cross sectional profile in a plane extending longitudinally through the frame that is also trapezoidal having a shape profile being similar to that of the cross sectional shape profile of the head. The head is configured to be mounted within the cavity with its thinner end being innermost and hence the opposite thicker end of the wedge being positioned towards a mouth of the cavity. This provides an effective wedging action when the head is drawn rearwardly by the anchor part so as to frictionally engage and entrap the region of the jaw plate within the cavity. Accordingly, and according to a preferred implementation, the head is generally wedge shaped in that the upper and lower head faces are aligned oblique relative to one another.

Preferably, the cavity and the head are dimensioned such that a majority or all of the head is capable of being accommodated within the cavity. More preferably, the head and the cavity are dimensioned such that all of the head is capable of being accommodated within the cavity when in use and frictionally engaged against a rearward part of the jaw plate within the cavity. Such an arrangement is advantageous to allow complete mating of the jaw plate against the frame and avoid a need to machine regions of the jaw plate or create cavities or recesses in the jaw plate that would otherwise be required to accommodate the head if it were to protrude forwardly from the support face of the frame. The entire thickness of the jaw plate therefore is capable of functioning to absorb the significant crushing forces and to effectively protect the retainer assembly from damage due to the crushable material. Optionally, the head may protrude from the frame cavity such that a corresponding region of the plate comprises a plate cavity to receive a part of the retainer head.

Preferably, the anchor part comprises at least one bolt, pin or shaft extending from the head and through the frame such that at least a portion of the anchor part protrudes or is accessible at a rearward facing side of the frame. More preferably, the anchor part comprises at least one bolt and the head comprises at least one bore to receive an end of the bolt. According to one implementation, the retainer assembly comprises two bolts and the head comprises two bores to receive respectively each of the bolts. Optionally, the retainer assembly further comprises resiliently deformable washers and locking nuts as will be appreciated that positionally lock the mounting bolts against the head and the jaw frame.

Preferably, the bolts comprise a bolt head that is received within respective recesses formed within the head of the retainer with clamping nuts being positioned at the rearwardmost end of the bolt stems by cooperating screw threads. Accordingly, bolt heads do not protrude beyond a forward facing front face of the head that could otherwise interfere with the jaw head.

Preferably, the assembly further comprises a release actuator extending through the frame having a first part accessible at a rearward facing side of the frame and a second part positioned at the head, the actuator configured to transmit a release force by the first and second parts to the head to force the head in a direction out of the cavity. Accordingly, the actuator is advantageous to provide a pushing force from the rearward side of the frame to the jaw plate and to force the jaw plate away from the frame support face. Optionally, the head may comprise a blind bore to receive an end of the bolt, pin or shaft. The bore may be threaded so as cooperate with a threaded end of the shaft of the actuator so as to facilitate mounting of the head in position at the frame. Preferably, the actuator comprises a bolt having a bolt head positioned at the rearward facing side of the frame and a bolt shaft extending through the frame and into the cavity and in contact with the head.

According to a second aspect of the present invention there is provided a retainer assembly, a jaw plate mountable against the support face of the frame, the jaw plate having at least one mount flange projecting rearwardly from a rear face of the jaw, wherein the mount flange is configured to be at least partially received within the cavity and frictionally engaged by the abutment face of the head to releasably secure the jaw plate at the jaw.

Preferably, the frame comprises a set of upper cavities positioned towards an upper end of the frame and a set of lower cavities positioned towards a lower end of the frame, the jaw plate comprising a set of upper mount flanges and a set of lower mount flanges, and the assembly comprises a set of retainers to cooperate with the set of upper cavities to releasably secure the jaw plate at the frame. The present retainer assembly is configured to pull the jaw plate into engaging contact against the support face of the frame and in particular to compress the plate in a lengthwise direction between the upper and lower mount flanges. The upper mount flanges comprise a generally upward facing first retainer face for frictional contact against the abutment face of the head and the lower flanges comprise a corresponding second retainer face for abutment against a region of the lower cavity or an intermediate retainer head positioned within the lower cavity.

Optionally, the frame comprises a pair of upper cavities and a pair of lower cavities positioned respectively towards but separated from the upper and lower lengthwise ends of the jaw frame. Similarly, and according to the preferred embodiment, the jaw plate comprises a pair of first mount flanges and a corresponding pair of second mount flanges positioned respectively towards but separated from the lengthwise ends of the jaw plate. Optionally, the jaw plate is symmetrical at a plane extending perpendicular to the length of the jaw plate and positioned at a mid-length position of the plate.

According to a third aspect of the present invention there is provided a jaw crusher comprising a jaw as claimed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1A:
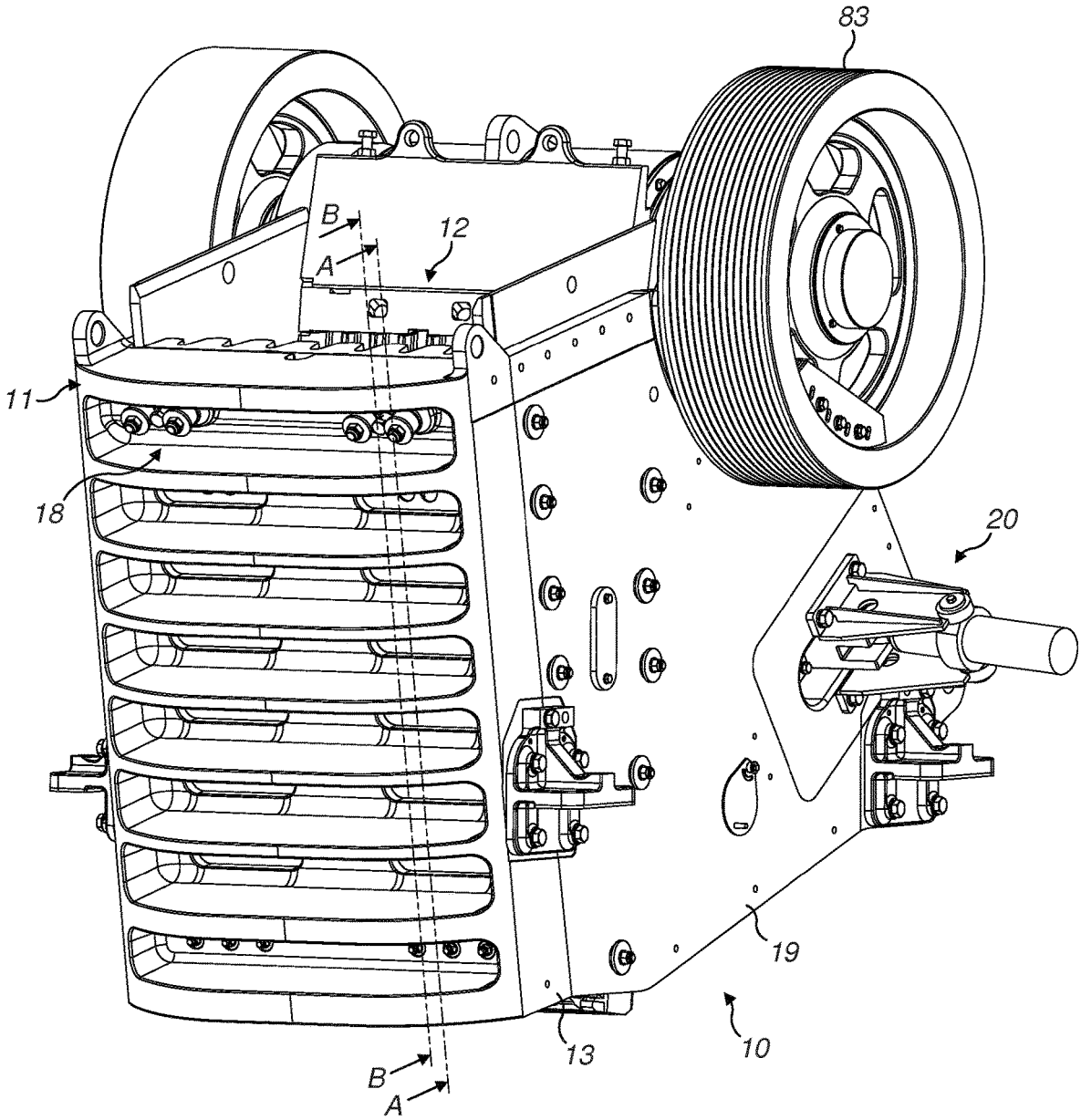
FIG. 1A is a perspective view of a jaw crusher according to a specific implementation of the present invention.
Figure 1B:
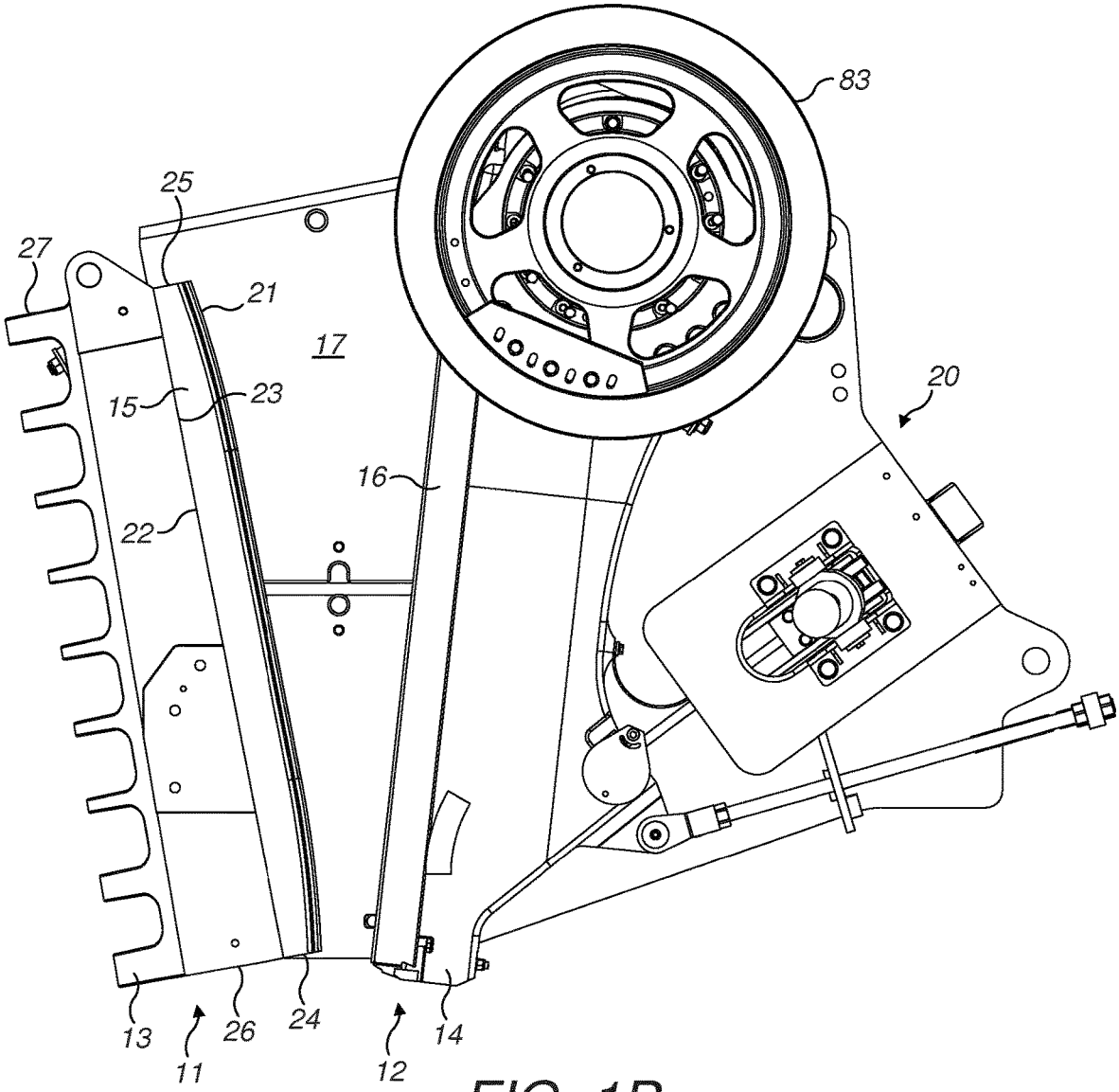
FIG. 1B is a side perspective view of the crusher of FIG. 1A with a side wall removed for illustrative purposes.
Figure 2:
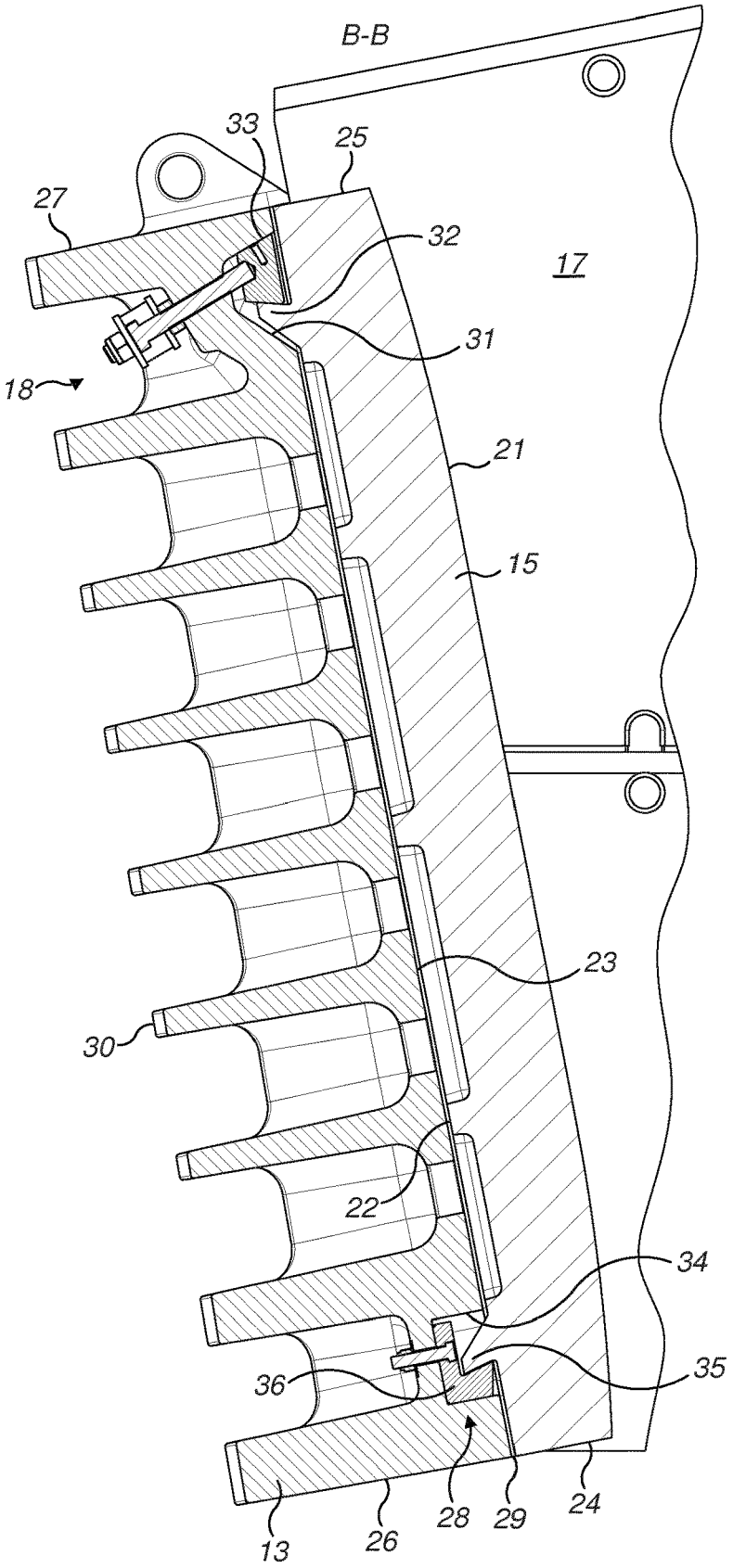
FIG. 2 is a cross section through B-B at the region of a stationary jaw of the crusher of FIG. 1A.

Referring to FIGS. 1A, 1B and 2 a jaw crusher 10 comprises a static jaw 11, commonly referred to as a front frame end positioned opposite a moveable jaw 12. The jaws 11, 12 between them and in combination with crusher side walls 19 (that in turn mount wear liner plates (not shown)) define a crushing chamber 17. The static jaw 11 comprises a frame 13 and a moveable jaw 12 similarly comprises a frame 14 with each frame 13, 14 mounting a respective jaw plate 15, 16. Each jaw plate 15, 16 comprises a generally planar crushing face 21 that may be regarded as front facing into the crushing chamber 17 and against which material is crushed by a reciprocating/oscillating motion of the moveable jaw 12 relative to stationary jaw 11. Referring to the jaw plate 15 mounted at frame 13, plate 15 further comprises a rearward facing rear mount face 22 for mounting against a support face 23 of the frame 13 via contact with an intermediate liner plate 29. Plate 15 further comprises a first upper lengthwise end 25 and a second lower lengthwise end 24 between which (in the lengthwise direction of the plate 15) is defined the crushing chamber 17. Similarly, frame 13 also comprises a first upper lengthwise end 27 and a second lower lengthwise end 26. According to the specific implementation of the present invention, the lengthwise ends 25, 24 of plate 15 are positioned so as to be approximately co-aligned with the respective lengthwise ends 27, 26 of the jaw frame 13. Such an arrangement is advantageous to maximise the height and volume of the crushing chamber 17 so as to optimise efficiency of reduction and crushing capacity for a given size of crusher 10. The reciprocating motion of moveable jaw 12 is driven by a motor (not shown) with the drive being translated to the jaw 12 via a series of V-belts (not shown) that extend around flywheels 83 mounted respectively at a jaw axle (not shown) extending through an upper region of moveable jaw 12. The oscillating motion of jaw 12 is stabilised by what is typically referred to as a back frame end 20.

Referring to FIG. 2, jaw plate 15 at the stationary jaw 11 is releasably anchored to the jaw frame 13 principally by a pair of primary retainer assemblies 18 mounted to extend through frame 13 towards the first upper lengthwise end 27 and co-positioned towards the first upper lengthwise end 25 of plate 15. The plate 15 is further secured at jaw frame 13 by a corresponding pair of secondary retainers 28 that extend through frame 13 at a region positioned towards the second lower lengthwise end 26 (and co-positioned at the second lower lengthwise end 24 of plate 15). Each of the primary and secondary retainers 18, 28 are formed from a head that provides a wedging action to abut against a region of plate 15 and a corresponding anchor part that extends rearwardly through the body of the frame 13 with a portion of the anchor part being accessible and adjustable so as to tighten the primary and secondary retainers 18, 28 at the frame 13 and clamp the jaw plate 15 in the releasably locked position at the stationary jaw 11. In particular, each primary retainer 18 comprises a generally wedge-shaped head 33 with each secondary retainer 28 comprising an L-shaped head 36. Frame 13 comprises a pair of upper cavities 31 recessed in support face 23 that extend rearwardly from support face 23 towards a rearwardmost region 30 of frame 13. Similarly, frame 13 also comprises a pair of lower cavities 34 recessed into support face 23 and positioned towards the second lower lengthwise end 26. Each of the respective pairs of cavities 31, 34 and the respective heads 33, 36 are dimensioned such that heads 33, 36 are capable of being inserted and completely accommodated within each respective cavity 31, 34 such that when mounted in positon, no part of the head 33, 36 protrudes forwardly beyond support face 23 and a respective mouth 63, 70 of each respective cavity 31, 34.

As illustrated in FIG. 2, jaw plate 15 comprises a pair of first upper flanges 32 that project rearwardly from mount face 22 with flanges 32 positioned in the lengthwise direction a short distance separated from the first upper lengthwise end 25 of plate 15. Similarly, plate 15 further comprises a pair of second lower flanges 35 that also project rearwardly from mount face 22. Each of the respective upper and lower cavities 31, 34 are generally oversized relative to each respect head 33, 36 so as to provide a 'free volume' within each cavity 31, 34 to accommodate at least partially respective flanges 32, 35. Accordingly, as jaw plate 15 is brought into contact with jaw frame 13 via mating of the frame support face 23 and jaw mount face 22, the upper and lower flanges 32, 35 are accommodated within the respective cavities 31, 34 and are abutted by the respective heads 33, 36 of the respective retainers 18, 28. The anchor parts of the retainers 18, 28 may then be tightened at frame 13 so as to releasably lock plate 15 at the frame 13. Advantageously and as illustrated in FIG. 2, the primary and secondary retainers 18, 28, the frame 13 and the jaw plate 15 are configured such that the retainers 18, 28 are positioned exclusively at the rearward facing side of plate 15 so as to be entirely shielded and protected by plate 15 from the flow of crushable material passing through chamber 17. That is, no part of the primary and secondary retainers 18, 28 are exposed at the crushing chamber 17. In particular, each of the retainers 18, 28 is positioned in a lengthwise direction between frame lengthwise ends 26, 27 and plate lengthwise ends 24, 25. Accordingly, the retainers 18, 28 are not subject to aggressive wear resulting from contact with the crushable material and therefore do not require regular replacement. Additionally, the configuration of retainers 18, 28 and the corresponding frame 13 and plate 15 provide a configuration that maximises the length (height) of the chamber 17 in a vertical plane as the plate crushing face 21 extends the full length of frame 13 between ends 26, 27. The present plate retainer assembly and jaw plate provide a mechanism for releasably anchoring plate 15 at the jaw 11 (front frame end) to minimise the time required for the interchange of plates 15 and to reduce significantly the risks to maintenance personnel as there is no requirement to weld lifting ears onto the primary retainers 18 or the plate 15 (to facilitate dismounting) or to climb into the crushing chamber 17 as is common to conventional arrangements. Additionally, the subject invention is advantageous to allow the jaw plate 15 to 'grow' in a lengthwise direction due to the compressive action of crushing material within chamber 17. This 'growth' does not affect the locking action of retainers 18, 28 and in particular does not impede subsequent release of the retainers 18, 28 and the corresponding dismounting of the plate 15 from the frame 13. These advantages are achieved by positioning exclusively the retainers 18, 28 at the rearward side of plate 15 and in particular completely within the perimeter of plate 15 defined by the rearward mount face 22.

Figure 3:
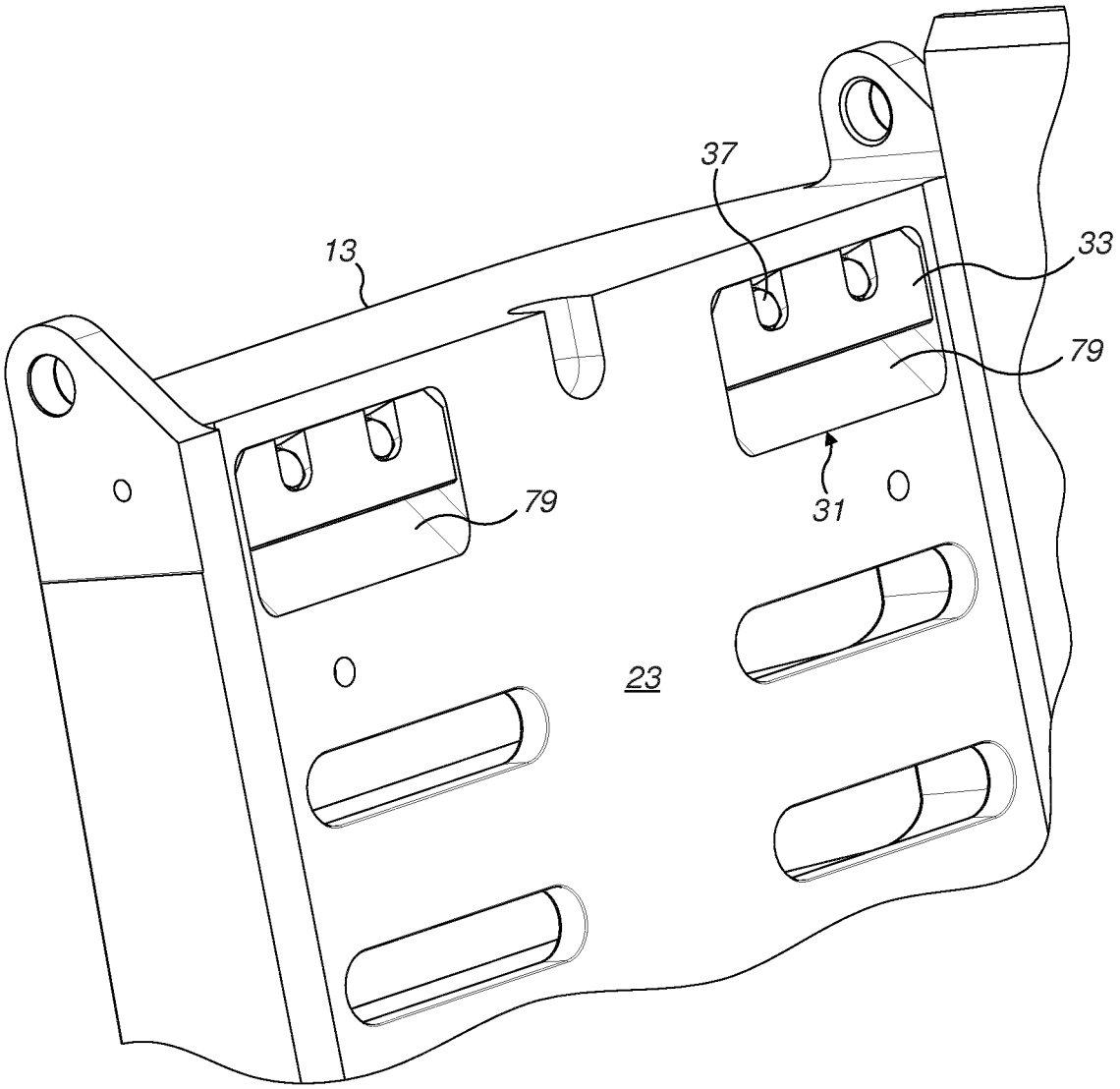
FIG. 3 is a perspective view of the stationary jaw frame of FIG. 2.
Figure 4:
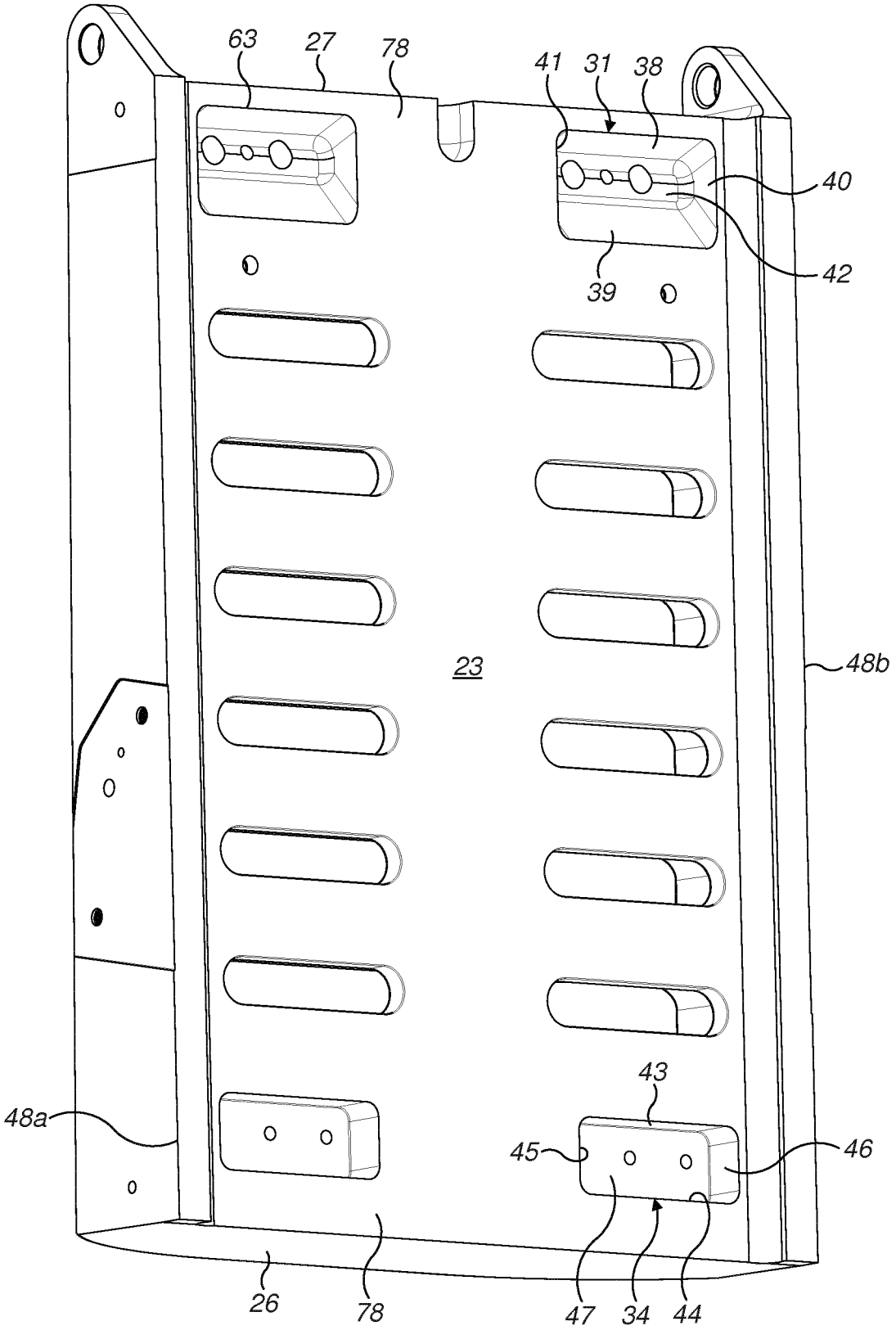
FIG. 4 is a further perspective view of the stationary jaw frame of FIG. 3.
Figure 9:
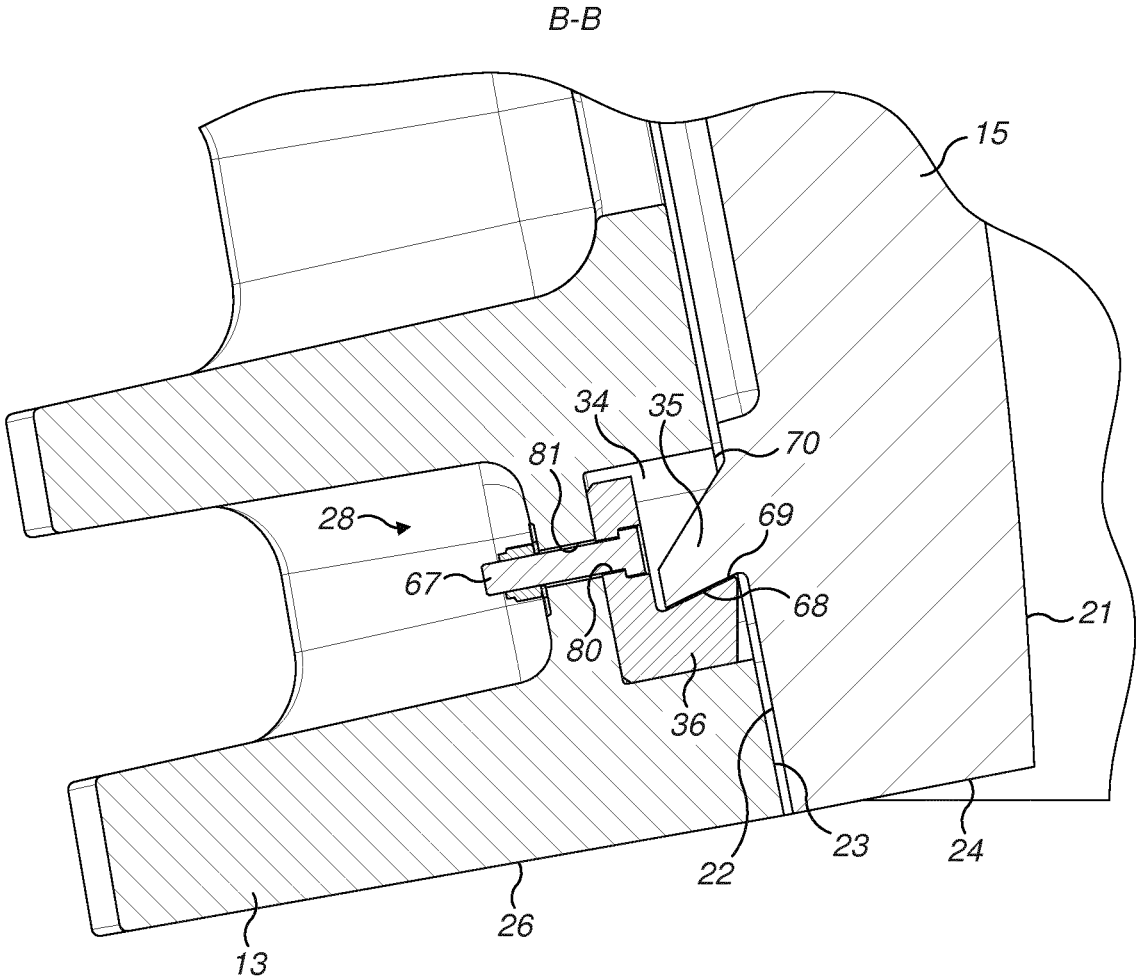
FIG. 9 is a magnified view of the cross section through B-B of FIG. 1A showing a lower region of the jaw plate and frame.

Referring to FIGS. 3, 4 and 9 each of the pair of the upper cavities 31 extend inwardly from frame support face 23 and are defined by a respective upper and lower cavity face 38, 39; a pair of opposed side faces 40, 41 and an innermost terminal end face 42 positioned rearwardmost of the cavity walls relative to support face 23. The upper and lower faces 38, 39 extend transverse to the plane of support face 23 and each other such that the height and a cross sectional area of the cavity decreases from the cavity mouth 63 (extending coplanar with support face 23) to the terminal end face 42. Relative to a horizontal plane, lower cavity face 39 may be regarded as inclined whilst upper cavity face 38 is declined. Each of the first upper cavities 31 are spaced apart in the widthwise direction of frame 13 so as to be positioned towards the lengthwise extending sides 48*a*, 48*b* of frame 13. A central region 78 of support face 23 is not recessed. Additionally, each cavity 31 is positioned a short separation distance from the upper lengthwise end 27 of the frame 13. Similarly, a pair of lower cavities 34 are positioned a short separation distance from the frame lower second lengthwise end 26 with these cavities 34 also positioned towards the lengthwise sides 48*a*, 48*b*. Cavities 34 are similarly separated by the central region 78 of support face 23 which is not recessed. Each of the lower cavities 34 is similarly defined by an upper and lower cavity face 43, 44; a pair of side faces 45, 46 and a terminal end face 47. However, lower faces 43, 44 are aligned parallel to one another and generally perpendicular to support face 23 such that each lower cavity 34 comprises a generally rectangular cross sectional profile throughout its depth between the cavity mouth 70 (that is co-aligned with support face 23) and terminal end face 47.

As indicated, upper cavities 31 comprise an internal volume that is oversized relative to retainer head 33 such that each head 33 may be accommodated fully within each cavity 31 as illustrated in FIGS. 2 and 3. Additionally, each retainer assembly 18 comprises a pair of mounting bolts (described with reference to FIGS. 5 to 7) each having a bolt head 37 that is received within the retainer head 33 such that no part of the mounting bolts project forwardly from support face 23 and beyond the mouth 63 of each cavity 31. Accordingly, all parts of the retainer assembly 18 are mounted rearwardly of frame support face 23 so as to be entirely partitioned from the crushing zone 17 by the full length and width of jaw plate 15.

Figure 5:
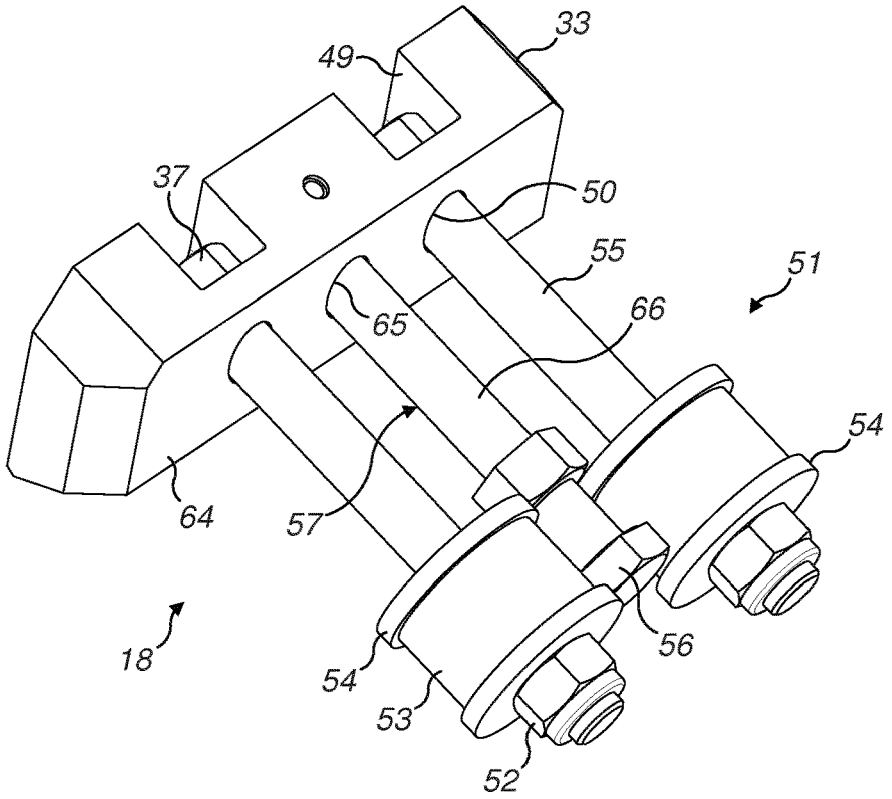
FIG. 5 is a perspective view of a retainer assembly to releasably anchor a jaw plate at the frame of FIG. 3.
Figure 6:
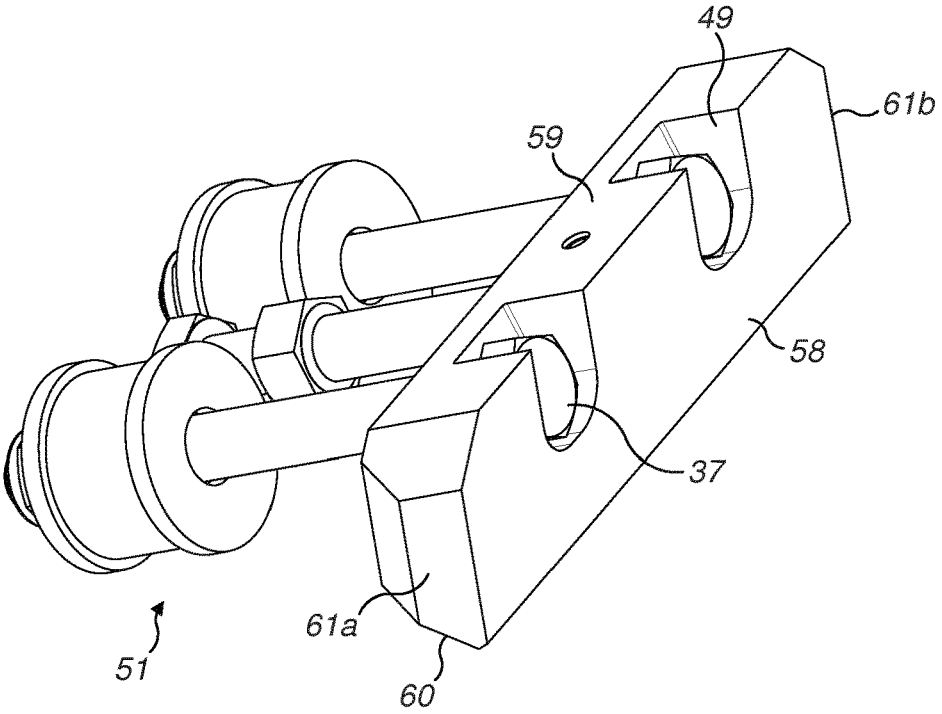
FIG. 6 is a further perspective view of the retainer assembly of FIG. 5.

Referring to FIGS. 5 and 6, each of the primary retainers 18 comprises a pair of mounting bolts indicated generally by reference 51 that extend rearwardly from head 33. Each bolt comprises an elongate shaft 55 extending from bolt head 37 that is in turn accommodated within a recess 49 with shafts 55 extending through a pair of bores 50 also formed within head 33. A locking nut 52 is adjustably mounted at each bolt shaft 55 via cooperating screw threads to act on rubber dampening washer 53 sandwiched between a pair of enlarged washers 54. The bolt shafts 55, nuts 52 and washers 53, 54 represent an anchor part of the primary retainers 18 positionable at the rearward region of jaw frame 13 so as to be accessible from the front end of crusher 10. Nuts 52 of the anchor part may be manually tightened to impart the locking action of the retainer assembly 18 and in particular the clamping action of the wedge shaped head 33 against the plate flanges 32. Each retainer 18 also comprises a release actuator indicated generally by reference 57 formed as a bolt having a bolt head 56 and an elongate shaft 66. A distal end of shaft 66 is engagable within a blind bore 65 extending within retainer head 33. Actuator bolt head 56 and shaft 66 are positioned between the pair of opposed mounting bolts 51 so as to extend into blind bore 65 located at a mid-length region of head 33. By adjustment of actuator 57 via rotation of head 56, a pushing release force is capable of being imparted to retainer head 33 when mounting bolts 51 are loosened via nuts 52. Accordingly, actuator head 56 is capable of being pushed from a fully abutted and locked position against cavity 31 and plate flange 32. Additionally, release actuator 57 may be used (via an operator manually manipulating the shaft 66 from the rearward region of the front frame end 11) to help position and maintain wedge 33 against the cavity upper face 38, so as to in turn, allow flange 32 to be inserted into the lower region of cavity 31.

Each retainer head 33 is generally elongate in a widthwise direction of frame 13 and plate 15 with the length of head 33 being slightly less than the corresponding length of cavity 31 in the widthwise direction of frame 13. Retainer head 33 comprises a front face 58, an upper and lower head face 59, 60, a pair of lengthwise end faces 61*a*, 61*b* and a rear face 64. Bolt head receiving recesses 49 extend inwardly from retainer head front face 58 and upper head face 59. According to the cross-sectional wedge-shaped profile of retainer head 33, the upper and lower head faces 59, 60 are aligned transverse to one another such that the cross sectional head profile is trapezoidal.

Figure 7:
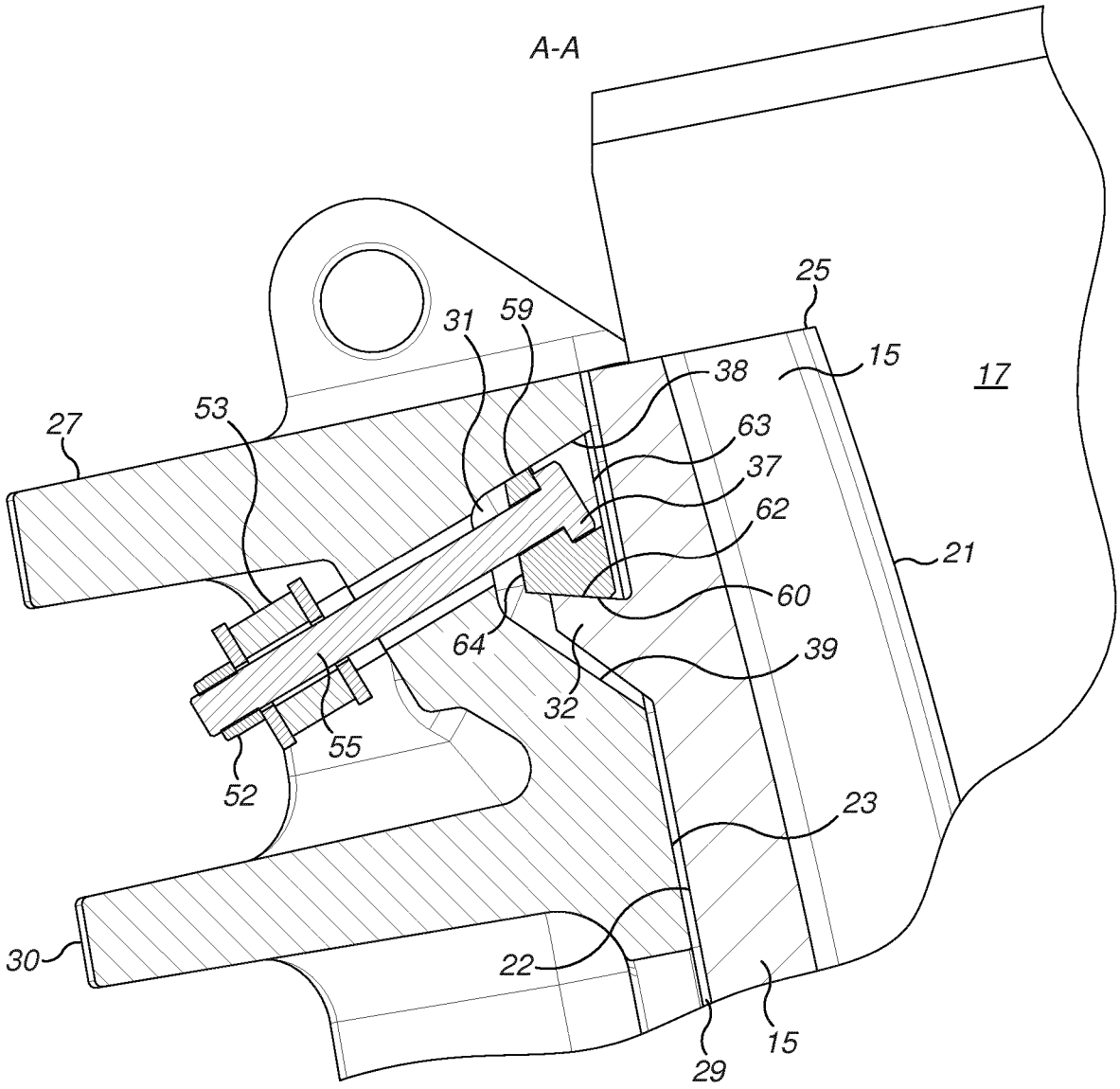
FIG. 7 is a cross section through A-A at the region of the stationary jaw of the crusher of FIG. 1A.
Figure 8:
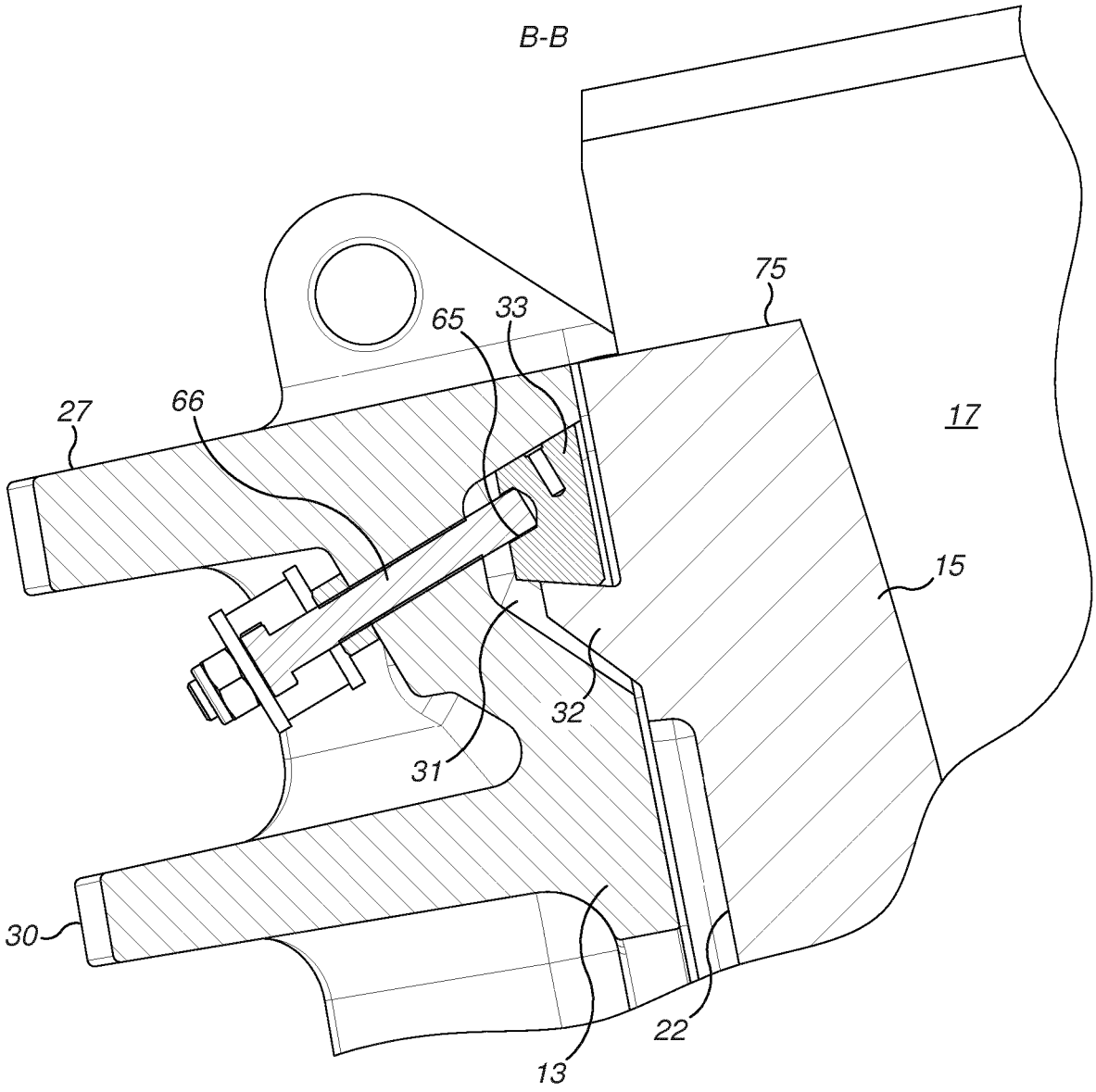
FIG. 8 is a magnified view of the cross section through B-B of FIG. 1A showing an upper region of the jaw plate and frame.

Referring to FIGS. 7 and 8, crushing plate 15 is capable of being releasably clamped at jaw 11 via abutted mating contact between retainer heads 33, cavities 31 and plate flanges 32. As illustrated in FIG. 3, with each head 33 located within each cavity 31 (at an upper region of the cavity) with upper head face 59 in contact with upper cavity face 38, a 'free volume' 79 is created at the lower region of cavity 31. This 'free volume' 79 is defined by lower head face 60 and lower cavity face 39. A size of the flange accommodating region 79 is suitable to accommodate a plate flange 32 that may be inserted into cavity 31 below head 33 with mounting bolts 51 in an untightened ('loose') state at the frame rearward region 30. As bolts 51 are tightened (via nuts 52) head 33 is drawn into the depth of cavity towards cavity terminal end face 42 and is prevented from bottoming within the cavity by abutment with a plate flange 32. In particular, lower head face 60 (alternatively termed an abutment face) is configured to abut a corresponding first retainer face of flange 32. Continued tightening of mounting bolts 51 provides a corresponding compressive force onto plate flange 32 so as to compress the plate 15 against frame 13. A small spatial gap is provided between flange 32 and lower cavity face 39 so as to prevent the flange bottoming within the cavity which would otherwise reduce the locking force provided by retainer assembly 18. Accordingly, head rear face 64 is prevented from bottoming against cavity terminal end face 42 by abutment contact of the head 33 with flange 32. Importantly, head 33 comprises a thickness between the front and rear faces 58, 64 that is less than a corresponding depth of cavity 31 between the cavity mouth 63 and the cavity terminal end face 42. Liner plate 29 comprises an aperture of a suitable size to allow passage of head 33 into and from cavity 31. In a further embodiment, head 33 may protrude from cavity 31 and through the liner plate aperture so as to be received within a corresponding cavity (not shown) formed within plate 15.

Referring to FIG. 9, each secondary lower retainer 28 comprises a head 36 mountable within each cavity 34 and a corresponding anchor part indicated generally by reference 67. Head 36 is generally L-shaped in cross-section so as to seat against cavity lower face 44 and cavity terminal end face 47. Each anchor part 67 comprises a set of mounting bolts that extend through head 36 and frame 13 via respective bores 80, 81. Accordingly by tightening the bolts of anchor part 67, head 36 is capable of being secured and accommodated completely within the cavity 34 at the lower region of the cavity 34. Accordingly, a free volume is provided at an upper region of each cavity 34 into which is received each of the respective lower plate flanges 35 extending rearwardly from plate mount face 22. In particular, head 36 comprises an abutment face 69 to abut against a generally downward facing second retainer face 68 of second flange 35. The cooperative second retainer face 68 and abutment face 69 are declined downwardly from support face 23 so as to allow plate 15 to rest against frame 13 exclusively via flange 35 being accommodated within cavity 34 and resting upon head 36 (mounted exclusively within cavity 34). With plate 15 mounted in position as illustrated in FIG. 9, the respective nuts 52 of the anchor parts are tightened so as to compress plate 15 against frame 13. The compression and locking force is facilitated as the respective upper and lower abutment faces 60, 69 of heads 33, 36 extend oblique relative to one another (being inclined respectively upwardly and downwardly) for mating contact against the respective angled first and second retainer faces 62, 68 of each respective upper and lower flanges 32, 35.

Figure 10:
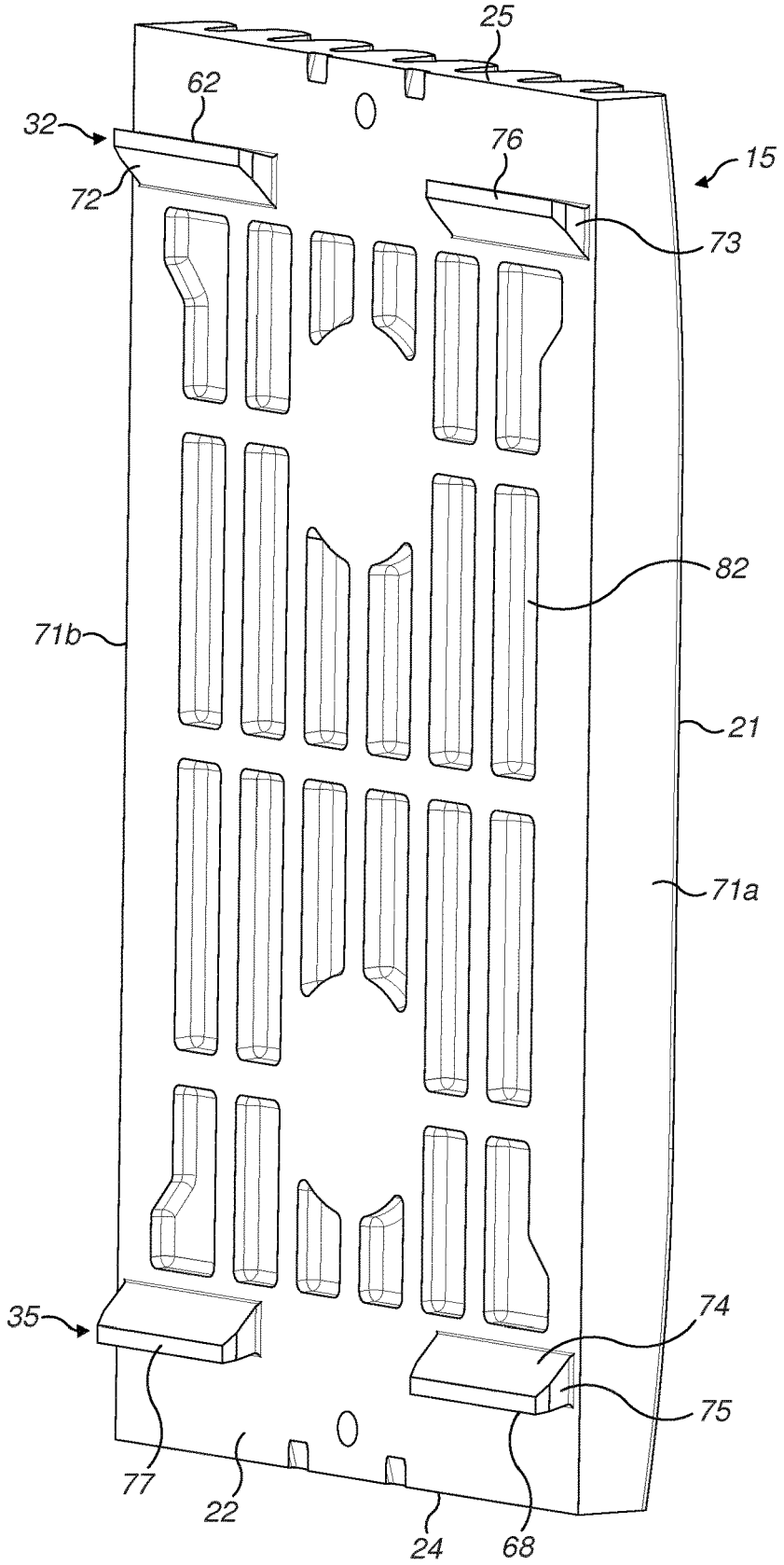
FIG. 10 is a rear perspective view of a jaw plate mountable at the stationary jaw frame of FIG. 1B.
Figure 11:
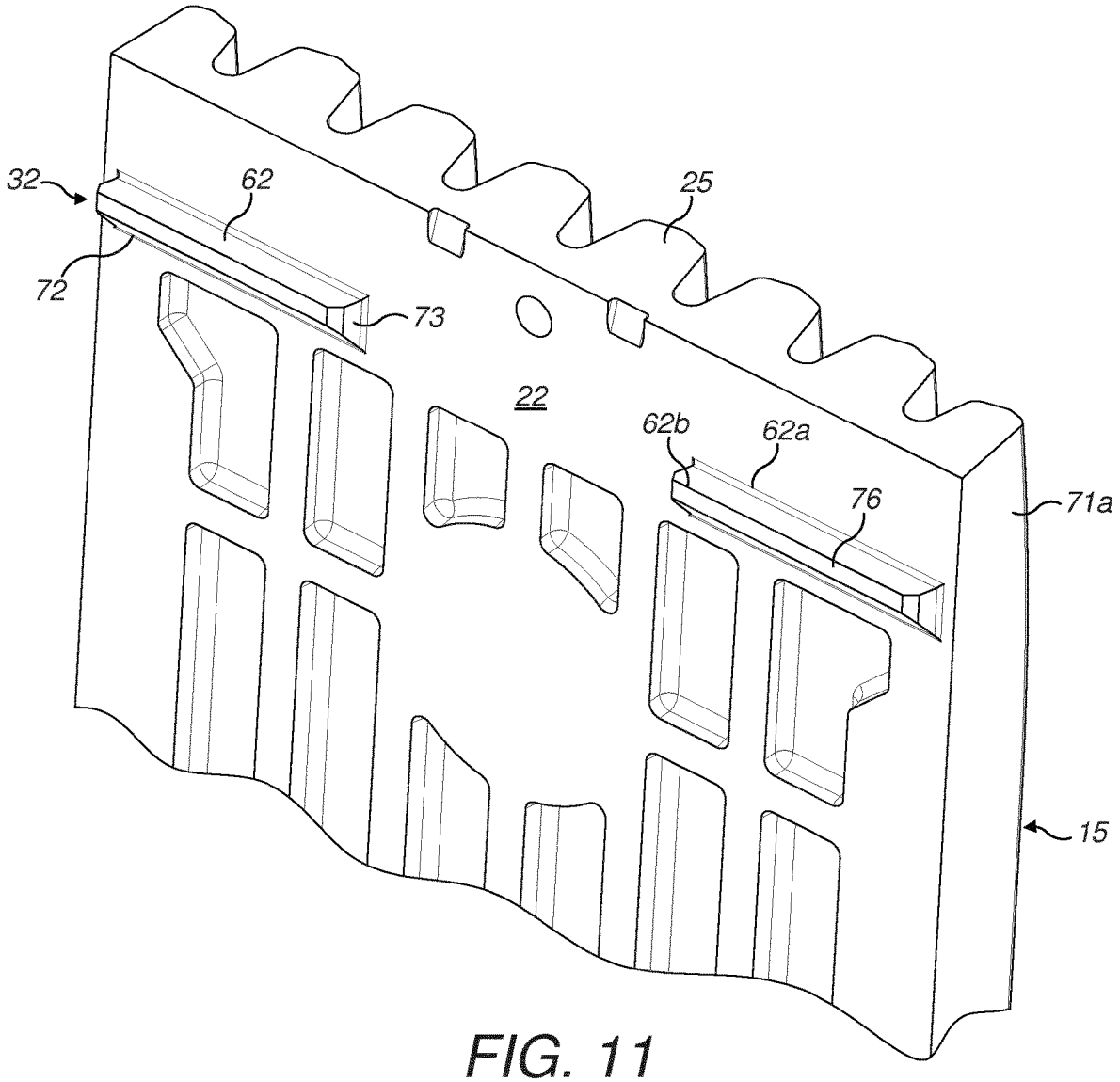
FIG. 11 is a further perspective view of an upper end of the jaw plate of FIG. 10.

Referring to FIGS. 10 and 11, jaw plate 15 comprises a perimeter defined by the first and second lengthwise ends 25, 26 and a pair of opposed parallel lengthwise extending sides 71*a*, 71*b*. Rear mount face 22 is generally planar except for the pair of rearward projecting first (or upper) mount flanges 32 and the corresponding pair of second (or lower) mount flanges 35. Additionally, a set of casting recesses 82 are embedded to extend into the body of plate 15 from rear mount face 22. Being conventional to crusher plates 15, crushing face 21 comprises a set of lengthwise extending ribs running between the lengthwise ends 25, 26. Each of the first mount flanges 32 is defined by the first retainer face 62 orientated towards first end 25, a bottom face 72 and a pair of lengthwise end faces 73. First retainer face 62, as indicated, is generally upward facing towards first ends 25 and is generally planar between lengthwise end faces 73 and an innermost edge 62*a* and a rearwardmost edge 62*b* that extend lengthwise between end faces 73. Due to the inclined orientation of retainer face 62, the rearwardmost edge 62*b* is positioned closer to plate first end 25 relative to innermost edge 62*a* in the lengthwise direction of plate 15. Accordingly, each of the first flanges 32 is formed as a shelf projecting rearwardly from plate mount face 22. Each flange 32 extends approximately one third of the width of plate 15 between lengthwise sides 71*a*, 71*b*. As indicated, the length of each flange 32 is slightly less than the corresponding length of each cavity 31 so as to allow the flanges 32 to be inserted completely within the free volume region 79 below each retainer head 33. Each of the second mount flanges 35 mounted towards plate second (or lower) end 26 may be regarded as the effective mirror image of the first flanges 32 with regard to their general shaped profile and their positioning at the rear face 22 with regard to the separation distance between plate lengthwise end 26 and the distance by which the flanges 35 extend across plate 15 between lengthwise sides 71*a*, 71*b*. Accordingly, each second flange 35 is defined by a pair of lengthwise end faces 75, the second retainer face 68 and an opposed upward facing face 74. For ease of mounting the plate 15 at frame 13 and potentially to extend its operation lifetime, plate 15 is symmetrical in both a horizontal and a vertical plane bisecting the plate 15 at a mid-region across its width and a corresponding mid-region along it length.

Figure 12:
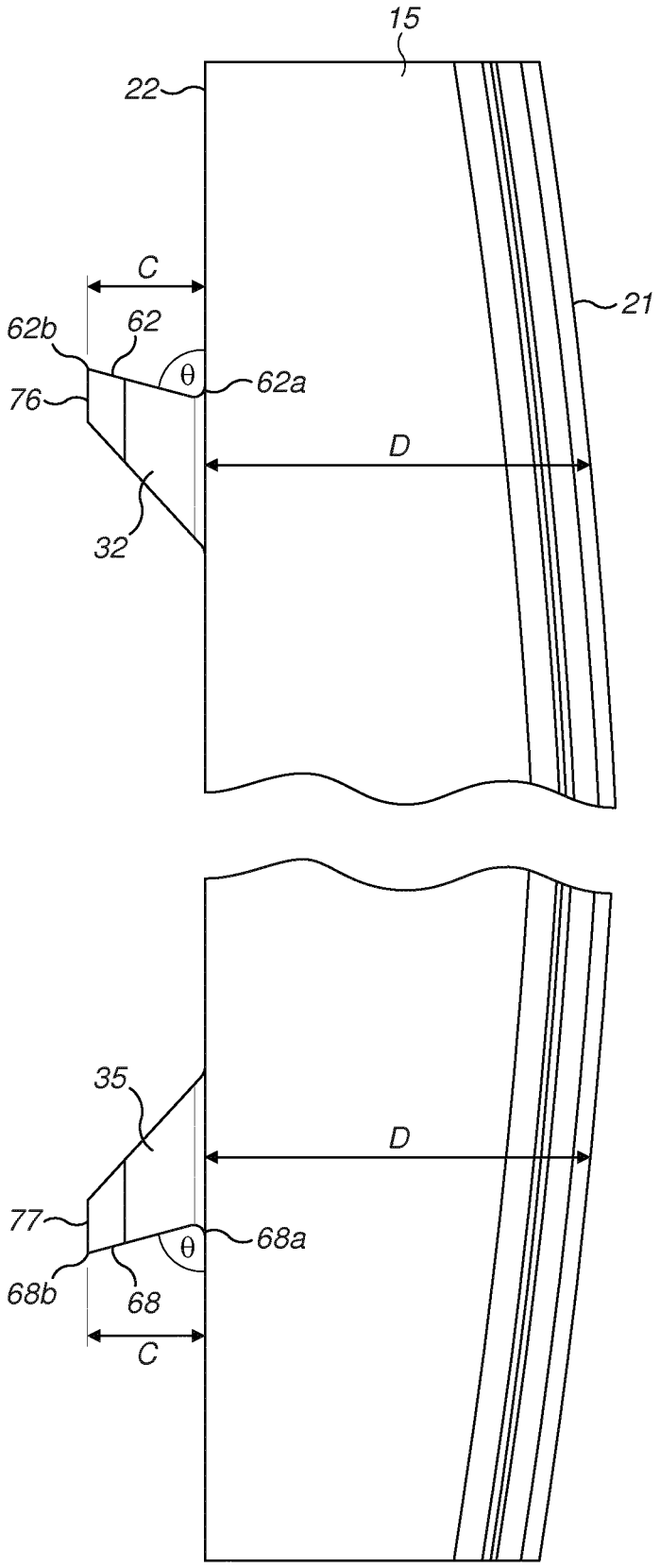
FIG. 12 is a perspective side view of the lengthwise ends of the jaw plate of FIG. 10.
Figure 13:
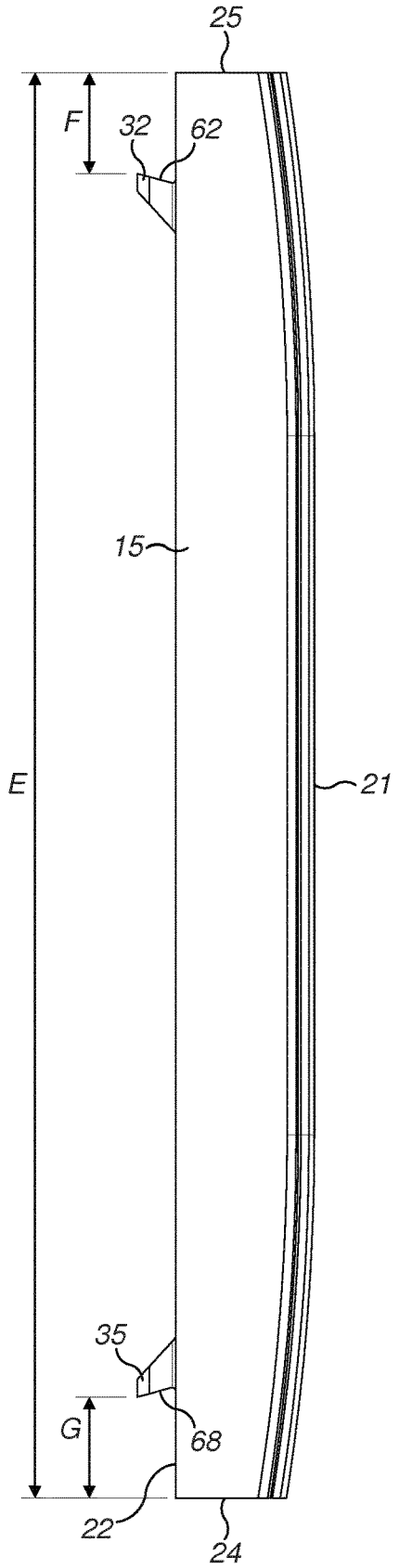
FIG. 13 is a perspective side view of the full jaw plate of FIG. 10.

Referring to FIGS. 12 and 13, a distance C by which the first and the second flanges 32, 35 extend rearwardly from plate mount face 22 is approximately 30% to 40% of a thickness D of plate 15 at the same length region at which the flanges 32, 35 are positioned. This distance C is dimensioned to be less than a depth of the respective cavities 31, 34 as defined between the cavity mouths 63, 70 and the cavity terminal end faces 42, 47. As such, the flanges 32, 35 are prevented from bottoming within each cavity that would in turn impede the clamping action of the retainers 18, 28. In particular, the rearwardmost lengthwise extending rear face 76, 77 of each flange 32, 35 is maintained in spaced apart relationship from the cavity terminal ends 42, 47. A distance F by which each flange 32, 35 is separated (in a lengthwise direction of the plate 15) from the respective first and second plate ends 25, 26 is in the range 5% to 10% of a total length E of plate 15 between lengthwise ends 25, 26. Accordingly, the flanges 32, 35 are positioned closer to the lengthwise ends 25, 26 relative to a mid-length region of the plate 15. An angle θ by which the first and second retainer faces 62, 68 of each flange 32, 35 extends relative to plate mount face 22 is in the range 15 to 25 degrees. This angled orientation of the retainer face 62, 68 provides the desired cooperative wedging action with the corresponding abutment faces 60, 69 of the respective retainer heads 33, 36.

As described, the configuration of the cavities 31, 34, retainer assemblies 18, 28 and the jaw plate 15 (via flanges 32, 35) is advantageous to provide a mechanism and method for releasably and securely mounting plate 15 at the jaw 11 so as to greatly facilitate mounting and dismounting with regard to time and the risk to service personnel. In particular, the present arrangement avoids a need to weld crane lifting ears onto the retainer assemblies 18 or the jaw plate 15 that is otherwise required for conventional retainer assemblies that are generally bigger and heavier. The present retainer assemblies 18, 28 may be mounted and manipulated conveniently by hand and do not require auxiliary lifting apparatus. Additionally, the need for service personnel to enter the crushing chamber 17 to facilitate removal of the plate 15 or retaining assemblies 18 is completely avoided. Moreover, as the primary retaining assemblies 18 are completely partitioned from the crushing chamber 17 they are not subjected to aggressive frictional wear and damage by the flow of material so as to provide a reliable and material efficient retainer assembly. As indicated, the dimensions of the crushing chamber 17 is maximised according to the subject invention as the plate 15 extends upwardly beyond the primary retainers 18 (and downwardly below the lower retainers 28) such that the respective upper and lower ends 25, 24 of plate 15 are approximately co-aligned with the respective uppermost and lowermost ends 27, 26 of the jaw 11.

The invention claimed is:

1. A jaw plate retainer assembly arranged to releasably secure a jaw plate at a jaw of a jaw crusher, the assembly comprising:

a frame forming part of the jaw crusher that, in part, defines one of the jaws of the crusher, the frame having a support face arranged for mounting the jaw plate against which material is to be crushed; and at least one retainer being separate from the frame and the jaw plate and extending through the frame and having a head to frictionally engage the jaw plate for mounting against the support face, and an anchor part to secure the head in position at the frame, wherein the frame includes at least one cavity recessed inwardly from the support face, the cavity and the head being dimensioned such that the head is capable of being at least partially accommodated within the cavity whilst leaving a free volume region to receive a part of the jaw plate, the head having at least one abutment face to frictionally engage the part of the jaw plate within the cavity and reasonably secure the jaw plate at the jaw.

2. The assembly as claimed in claim 1, wherein a height of the cavity in a lengthwise direction of the frame and/or the jaw is greater than a width of the head in the same lengthwise direction of the frame and/or the jaw and the free volume region is positioned below the head.

3. The assembly as claimed in claim 1, wherein the cavity is defined, in part, by an upper and a lower cavity face, the head being defined, in part, by an upper and a lower head face, the free volume region defined, in part, between the lower cavity face and the lower head face.

4. The assembly as claimed in claim 3, wherein the head is generally wedge shaped in that the upper and lower head faces are aligned oblique relative to one another.

5. The assembly as claimed in claim 1, wherein the cavity and the head are dimensioned such that a majority or all of the head is capable of being accommodated within the cavity.

6. The assembly as claimed in claim 1, wherein the anchor part includes at least one bolt, pin or shaft extending from the head and through the frame, such that at least a portion of the anchor part protrudes or is accessible at a rearward facing side of the frame.

7. The assembly as claimed in claim 6, wherein the anchor part includes at least one bolt and the head includes at least one bore arranged to receive an end of the bolt.

8. The assembly as claimed in claim 7, comprising two bolts and the head includes two bores arranged to receive, respectively, each of the bolts.

9. The assembly as claimed in claim 1, further comprising a release actuator extending through the frame, the actuator having a first part accessible at a rearward facing side of the frame and a second part positioned at the head, the actuator being configured to transmit a release force by the first and second parts to the head to force the head in a direction out of the cavity.

10. The assembly as claimed in claim 9, wherein the release actuator includes a bolt, pin or shaft extending through the frame between the rearward facing side and the cavity.

11. The assembly as claimed in claim 10, wherein the head includes a blind bore to receive an end of the bolt, pin or shaft.

12. The assembly as claimed in claim 10, wherein the actuator includes a bolt having a bolt head positioned at the rearward facing side of the frame and a bolt shaft extending through the frame and into the cavity and in contact with the head.

13. A jaw of a jaw crusher comprising:

a retainer assembly as claimed in claim 1; and a jaw plate mountable against the support face of the frame, the jaw plate having at least one mount flange projecting rearwardly from a rear face of the jaw, wherein the mount flange is configured to be at least partially received within the cavity and frictionally engaged by the abutment face of the head to releasably secure the jaw plate at the jaw.

14. The jaw as claimed in claim 13 wherein the frame includes a set of upper cavities positioned towards an upper end of the frame and a set of lower cavities positioned towards a lower end of the frame, the jaw plate including a set of upper mount flanges and a set of lower mount flanges, and wherein the assembly includes a set of retainers arranged to cooperate with the set of upper cavities to releasably secure the jaw plate at the frame.

15. A jaw crusher comprising a jaw as claimed in claim 13.

* * * * *